US008667636B2

(12) United States Patent
Berney et al.

(10) Patent No.: US 8,667,636 B2
(45) Date of Patent: Mar. 11, 2014

(54) FOLDING TROWEL ASSEMBLY WITH MULTIPLE BLADES

(71) Applicant: Thomson Tool Company Inc., Chilliwack (CA)

(72) Inventors: Stephen T. Berney, Chilliwack (CA); Wesley M. Arnold, Delta (CA)

(73) Assignee: Thomson Tool Company Inc., Chilliwack, British Columbia (CA)

( * ) Notice: Subject to any disclaimer, the term of this patent is extended or adjusted under 35 U.S.C. 154(b) by 0 days.

(21) Appl. No.: 13/854,121

(22) Filed: Mar. 31, 2013

(65) Prior Publication Data

US 2013/0255016 A1 Oct. 3, 2013

Related U.S. Application Data

(60) Provisional application No. 61/618,985, filed on Apr. 2, 2012.

(51) Int. Cl.
*E04G 21/20* (2006.01)
*E04F 21/165* (2006.01)

(52) U.S. Cl.
USPC ..... 15/105.5; 15/235.3; 15/235.4; 425/458

(58) Field of Classification Search
USPC ..... 15/105, 105.5, 235.3, 235.4, 235.8; 33/518; 425/458
See application file for complete search history.

(56) References Cited

U.S. PATENT DOCUMENTS

| | | | | |
|---|---|---|---|---|
| 2,237,378 | A * | 4/1941 | Thienemann | 33/501 |
| 2,561,521 | A | 7/1951 | Herbert | |
| 3,166,776 | A | 1/1965 | Selck | |
| 4,006,613 | A * | 2/1977 | Zion | 70/394 |
| 4,673,346 | A * | 6/1987 | Anderson | 425/458 |
| 4,724,572 | A | 2/1988 | Gringer | |
| 5,103,520 | A | 4/1992 | Mazzo | |
| 5,231,729 | A | 8/1993 | Rose | |
| 5,450,648 | A | 9/1995 | Dovin et al. | |
| 6,178,586 | B1 | 1/2001 | Jafarmadar | |
| 7,036,952 | B2 | 5/2006 | Zirk et al. | |
| 7,047,588 | B2 * | 5/2006 | Bennett | 15/105.5 |
| 7,213,283 | B2 | 5/2007 | Rivera | |
| 7,757,335 | B1 | 7/2010 | Servidio | |
| 2002/0162238 | A1 * | 11/2002 | Bakke et al. | 33/501.45 |

* cited by examiner

*Primary Examiner* — Randall Chin
(74) *Attorney, Agent, or Firm* — Corridor Law Group, P.C.

(57) ABSTRACT

A folding trowel assembly has multiple trowel blades of assorted types and sizes housed in a casing. The folding trowel assembly allows for different trowel blades to be unfolded and used as needed. A pivot mechanism includes a pivot pin for positioning each of the trowel blades into a working position at an adjustable angle relative to the casing. A release mechanism applies compression to the stacked trowel blades to inhibit rotation of the trowel blades about the pivot pin and relieves compression from the stacked trowel blades to permit rotation of the trowel blades about the pivot pin. An angle between the casing body and the casing neck tab allows trowel blades to be pivoted such that sufficient clearance is provided between the casing body and a work surface to permit the casing body to be used as a handle for each of the trowel blades.

19 Claims, 18 Drawing Sheets

FOLDING TROWEL ASSEMBLY WITH MULTIPLE BLADES

CROSS-REFERENCE TO RELATED APPLICATION

This application is related to and claims priority benefits from U.S. Provisional Patent Application Ser. No. 61/618,985 filed on Apr. 2, 2012, entitled "Folding Trowel Assembly With Multiple Blades". The '985 provisional application is hereby incorporated by reference herein in its entirety.

FIELD OF THE INVENTION

The present invention relates to a trowel assembly for distributing material on a work surface. In particular, the invention relates to a folding masonry trowel assembly with multiple blades and method of making the same.

BACKGROUND OF THE INVENTION

Trowels are used to spread material such as cement, filler, grout and the like on a work surface such as a floor, a wall, or similar surface. Masonry trowels are hand trowels used to spread or shape material such as mortar or concrete on brickwork or stonework.

Each trowel has a blade suitable for the material and work for which it is used, and a handle attached to the flat of the blade via a neck. A worker typically has a set of different trowels, each suitable for a different job. Trowels are generally stored in a tool box. At the beginning of each work day, the worker typically collects several trowels from the tool box. The worker may have to search through a cluttered tool box to find the necessary trowels, and it can be challenging to keep the trowels organized. The trowels required for the day's job are typically carried to a job site in a bucket or canvas tote bag. The trowels are generally of different lengths and shapes, and are therefore generally not stackable, and can take up significant volume in the bucket or tote. As the trowels are being used during the day, they may be left around the job site, as the worker is often working in different areas. The trowels tend to get lost or left on job sites. Smaller trowels are often carried in the back pocket of the workers' pants and tend to get hooked up on scaffolding, scrape walls or fall out. The trowels are not usually high on the priority list of tools to be put away after work. They can be easily mixed in with debris on job sites and accidently thrown away.

Conventional trowels come in an assortment of sizes with wooden or plastic handles. The welded components of each trowel can fatigue and/or break, thereby resulting in the handles separating from the trowels and rendering them useless as a practical matter. Trowels are frequently in need of being replaced because of breakage or loss.

The folding trowel assembly described in this application comprises a compact casing, and can be carried in a pouch, for example, that attaches to the belt loop of the worker's pants. The folding trowel assembly can comprise a number of different trowel blades housed in the casing, and is easy to carry.

The folding trowel assembly described in this application solves the problem of having to carry around multiple trowels in a bucket or canvas tote bag. The trowel assembly keeps the trowel blades safely stored and ready for use when needed. When the worker is finished with a particular trowel, the trowel can be cleaned off and folded back into the casing, ready for the next use. Workers can each have their own trowel assembly, reducing the likelihood of losing trowels at job sites. The trowel assembly also saves time in that the worker will not have to waste time each day searching out and selecting different trowels for the day's work.

SUMMARY OF THE INVENTION

A folding trowel assembly comprises:

(a) a stacked plurality of trowel blades, each of the trowel blades comprising a trowel, a trowel blade neck and a trowel blade neck tab, the trowel blade neck tab angled to the trowel blade neck and angled to the trowel, the trowel blade neck tab having a hole formed therein for receiving a pivot pin;

(b) a casing for housing the stacked plurality of trowel blades, the casing comprising a casing body, a casing neck and a casing neck tab, the casing neck tab angled to the casing neck and angled to the casing body, the casing neck tab having at least one hole formed therein to receive the pivot pin;

(c) a pivot mechanism comprising at least the pivot pin for positioning each of the trowel blades into a working position at an adjustable angle relative to the casing;

(d) a release mechanism operatively associated with the pivot mechanism, the release mechanism capable of applying compression to the stacked plurality of trowel blades to inhibit rotation of the trowel blades about the pivot pin and relieving compression from the stacked plurality of trowel blades to permit rotation of the trowel blades about the pivot pin;

In the foregoing folding trowel assembly, an angle between the casing body and the casing neck tab allows trowel blades to be pivoted such that sufficient clearance is provided between the casing body and a work surface to permit the casing body to be used as a handle for each of the trowel blades.

In a preferred embodiment of the folding trowel assembly, the casing neck defines a plane that is at a first angle of between 20 degrees and 60 degrees to a plane defined by the casing body, and the casing neck tab defines a plane that is at a second angle of between 5 and 30 degrees to the plane defined by the casing body, wherein the second angle is less than the first angle. Preferably, the first angle is about 45 degrees and the second angle is about 12 degrees. Each of the trowel blades is preferably rotatable approximately 180 degrees from a housed position within the casing.

In a preferred embodiment of the folding trowel assembly, the pivot pin comprises a threaded end and a flanged end, and the release mechanism comprises a threaded fastener cooperative with the pivot pin threaded end. In operation, rotation of the fastener in a first direction compresses the trowel blades against the pivot pin flanged end and rotation of the fastener in a second, opposite direction relieves compression of the trowel blades against the pivot pin flanged end. The threaded fastener preferably comprises a thumb lock.

In another preferred embodiment of the folding trowel assembly, the pivot pin comprises a cam end and a flanged end, and the release mechanism comprises a cam lever cooperative with the cam end. In operation, orienting the cam lever in a closed position compresses the trowel blades against the pivot pin flanged end and orienting the cam lever in an open position relieves compression of the trowel blades against the pivot pin flanged end.

In a preferred embodiment, the folding trowel assembly further comprises a plurality of washers mounted on the pivot pin and interposed between neighboring trowel blade neck tabs.

In a preferred embodiment of the folding trowel assembly, the pivot mechanism comprises first physical features formed on one side of the trowel blade neck tab and second physical features formed on an opposite side of the trowel blade neck tab, the first and second physical features cooperative with second and first physical features, respectively, formed on neighboring trowel blade neck tabs. In operation, rotating a trowel blade about the pivot pin orients the trowel blade at fixed angular increments upon compression of the stacked plurality of trowel blades. The first physical features preferably comprise radial ridges formed on the trowel blade neck tab first side and cooperating radial indentations formed on the trowel blade neck tab second side.

In another preferred embodiment of the folding trowel assembly, the pivot mechanism further comprises a plurality of locking washers mounted on the pivot pin and interposed between neighboring trowel blade neck tabs, and the locking washers comprise first physical features formed on one side thereof and second physical features formed on an opposite side thereof. The first and second locking washer physical features are cooperative with second and first physical features, respectively, formed on the neighboring trowel blade neck tabs.

In a preferred embodiment of the folding trowel assembly, the pivot pin has a flanged end and a blade guard extending therefrom for shielding the plurality of trowel blades housed within the casing.

In a preferred embodiment of the folding trowel assembly, for each of the plurality of trowel blades, the trowel blade neck defines a plane that is at a first angle of between 20 degrees and 60 degrees to a plane defined by the trowel. Preferably, the trowel blade neck tab defines a plane that is at a second angle of between 5 and 30 degrees to the plane defined by the trowel, and the second angle is less than the first angle.

In another preferred embodiment of the folding trowel assembly, the casing body has at least one of a level mounted on an exterior facing surface thereof and ruler markings formed on an exterior surface thereof.

In another preferred embodiment of the folding trowel assembly, the release mechanism is a push-button release mechanism. The folding trowel assembly preferably further comprises a plurality of spacing washers mounted on the pivot pin and interposed between neighboring trowel blade neck tabs, and the push-button release mechanism comprises:

(i) an outer sleeve having a depressor end, the outer sleeve having an interior cavity formed therein for receiving the pivot pin, the outer sleeve having a plurality of spaced concentric grooves formed in an exterior surface thereof, each of the grooves alignable with one of the spacing washers, the outer sleeve exterior surface normally abutting the plurality of trowel blades and inhibiting rotational movement of the trowel blades about the pivot pin; and (ii) a resilient compression mechanism at an end of the pivot pin opposite the outer sleeve depressor end;

In operation, translating the outer sleeve depressor end toward the pivot pin opposite end aligns the grooves with the spacer washers, thereby dissociating the outer sleeve exterior surface from the trowel blades and permitting the trowel blades to rotate about the pivot pin.

In the foregoing preferred embodiment of the folding trowel assembly, the depressor end of the outer sleeve comprises a push-button mounted on the casing neck. The pivot pin is preferably flanged at the end opposite the outer sleeve depressor end, and the resilient compression mechanism comprises a spring interposed between the pivot pin flange and the outer sleeve. Preferably, each of the trowel blade neck tabs has at least one recess formed therein, and the at least one recess cooperates with the outer sleeve exterior surface such that the trowel blades are positionable at at least one discrete angle from a housed position within the casing.

In a preferred embodiment, a folding trowel assembly comprises:

(a) a stacked plurality of trowel blades, each of the trowel blades comprising a trowel, a trowel blade neck and a trowel blade neck tab, the trowel blade neck tab angled to the trowel blade neck and angled to the trowel, the trowel blade neck tab having a hole formed therein for receiving a pivot pin;

(b) a plurality of spacing washers, each of the spacing washers interposed between neighboring trowel blade neck tabs;

(c) a casing for housing the stacked plurality of trowel blades, the casing comprising a casing body, a casing neck and a casing neck tab, the casing neck tab angled to the casing neck and angled to the casing body, the casing neck tab having at least one hole formed therein to receive the pivot pin;

(d) a pivot mechanism comprising at least one pivot pin for positioning each of the trowel blades into a working position at an adjustable angle relative to the casing;

(e) a release mechanism mounted on the casing neck, the release mechanism comprising:

(i) an outer sleeve having a depressor end, the outer sleeve having an interior cavity formed therein, the outer sleeve having a plurality of spaced concentric grooves formed in an exterior surface thereof, each of the grooves alignable with one of the spacing washers, the outer sleeve exterior surface normally abutting the plurality of trowel blades and inhibiting rotational movement of the trowel blades about the pivot pin;

(ii) a release pin extending within the outer sleeve interior cavity, the release pin having a resilient compression mechanism at an end of the release pin opposite the outer sleeve depressor end.

In the foregoing preferred embodiment, an angle between the casing body and the casing neck tab allows trowel blades to be pivoted such that sufficient clearance is provided between the casing body and a work surface to permit the casing body to be used as a handle for each of the trowel blades. In operation, translating the outer sleeve depressor end toward the release pin opposite end aligns the grooves with the spacer washers, thereby dissociating the outer sleeve exterior surface from the trowel blades and permitting the trowel blades to rotate about the pivot pin.

DETAILED DESCRIPTION OF PREFERRED EMBODIMENT(S)

The present folding trowel assembly comprises multiple trowel blades of assorted types and sizes housed in a casing that serves as a handle, and allows for different trowel blades to be unfolded and used as needed. It is more efficient for a worker to have all the blades that might be needed contained in a single unit compact assembly.

The present folding trowel assembly comprises a pivot mechanism that allows the position of the trowel blade to be deployed at an adjustable angle relative to the casing. Generally, the selected trowel blade will be deployed so that it is aligned with the casing such that the blade is rotated approximately 180 degrees from its folded (stored) position. The angle between the deployed trowel blade and the casing (serving as a handle) can be adjusted, however, to suit different work tasks if desired.

Figure 1:
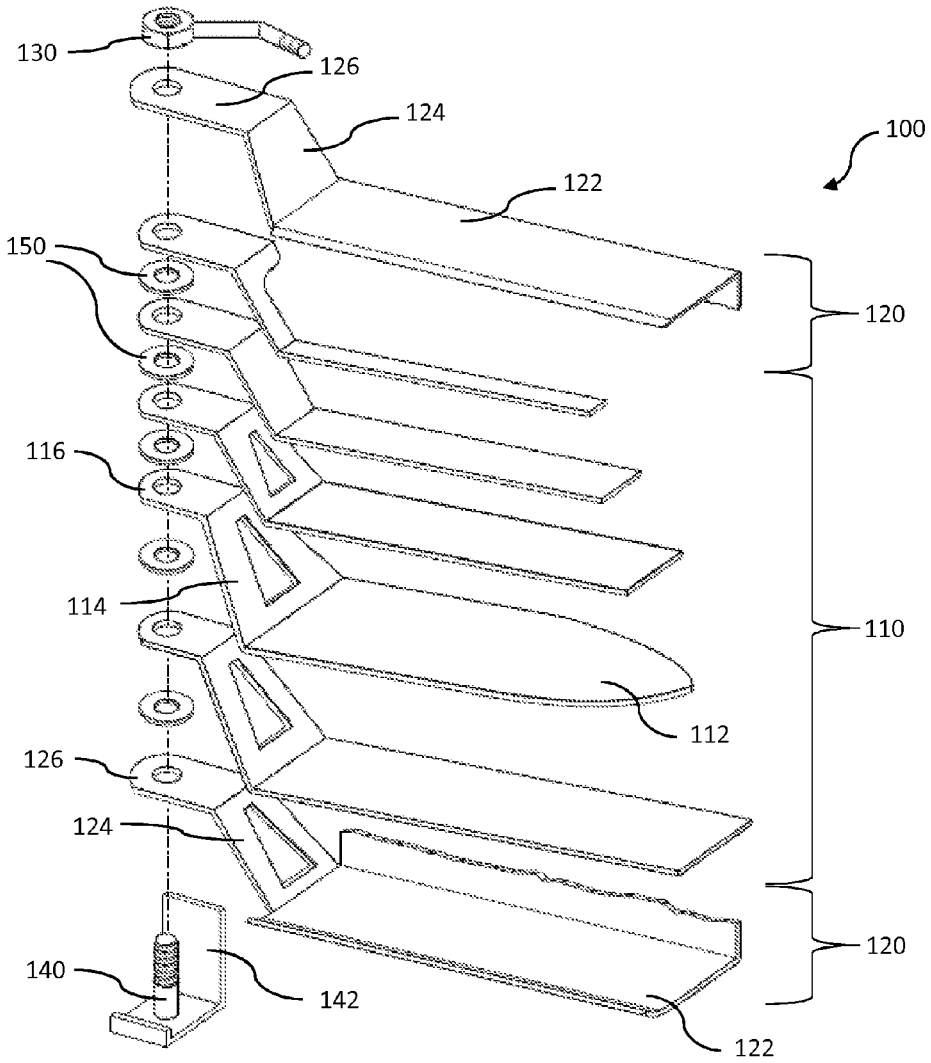
FIG. 1 is an exploded view of one embodiment of a folding masonry trowel assembly with multiple blades.

FIG. 1 is an exploded view of one embodiment of a folding masonry trowel assembly 100 comprising multiple trowel blades 110. Trowel blades 110 are housed in a casing 120 (shown split in two) and are shown here in a stored (stacked or folded) position.

As further shown in FIG. 1, each trowel blade 110 comprises trowel 112, neck 114 and neck tab 116. Casing 120 comprises casing body 122, neck 124 and neck tab 126. Neck 124 is at an angle to casing body 122. Neck tab 126 is configured at an angle to neck 124 and casing body 122. There are holes formed through neck tabs 116 and 126 to receive pivot pin 140. Trowel blades 110 are stacked and secured within casing 120 by mounting them on pivot pin 140 against blade guard 142 and tightening thumb lock device 130 at the top of pivot pin 140. Optional washers 150 can be used to separate trowel blades 110 in this hinged, vertically-stacked position. Casing 120 can be made of metal or another suitable material.

In one embodiment, the holes in neck tabs 116 and 126 are ⅜". Thumb lock device 130 can be used to lock the mechanism when trowel blades 110 are in a desired position. Pivot pin 140 and thumb lock device 130 can be tightened to hold the selected trowel blade firmly in position and ready for use.

The angle between casing body 122 and neck tab 126 allows trowel blades 110 to be pivoted into a working position in a manner which provides clearance between casing body 122 (serving as a handle) and a work surface. Clearance is described in further detail below. In an example embodiment, the angle between casing body 122 and neck 124 of casing 120 is 45 degrees, and the angle between the casing body 122 and neck tab 126 of the casing is 12 degrees.

Figure 2:
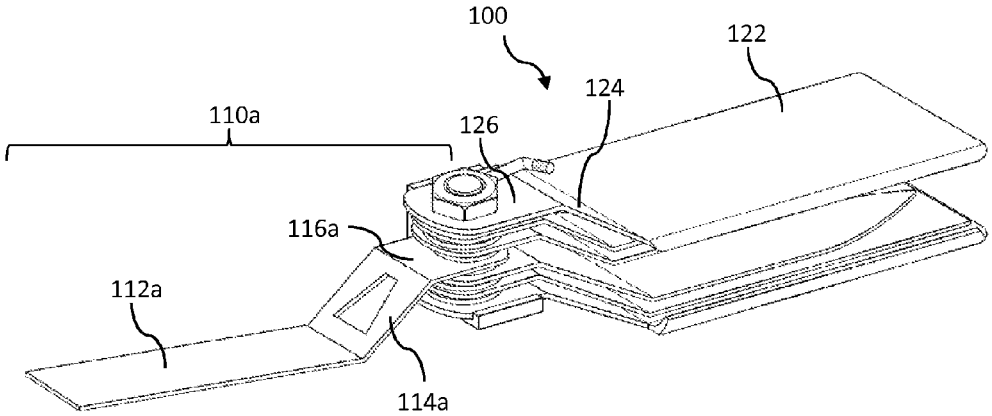
FIG. 2 is a view of the folding masonry trowel assembly of FIG. 1 with a single trowel blade unfolded in a deployed position ready for use.

FIG. 2 is a view of folding masonry trowel assembly 100 of FIG. 1 with a single trowel blade 110*a* unfolded in a deployed position ready for use. Casing body 122 serves as a handle for trowel blade 110*a*. When trowel 112*a* of trowel blade 110*a* is placed flat on a work surface (not shown), casing body 122 is at an angle to the work surface (and not parallel to the work surface). The angle of the handle to the work surface depends on the angle between trowel 112*a* of trowel blade 110*a* and neck 116*a*, the angle between casing body 122 and casing neck 126, the angle between neck 114*a* and neck tab 116*a*, and the angle between casing neck 126 and casing neck tab 124. The values of these four angles are selected such that the worker can readily spread or shape the material on the work surface.

Figure 3:
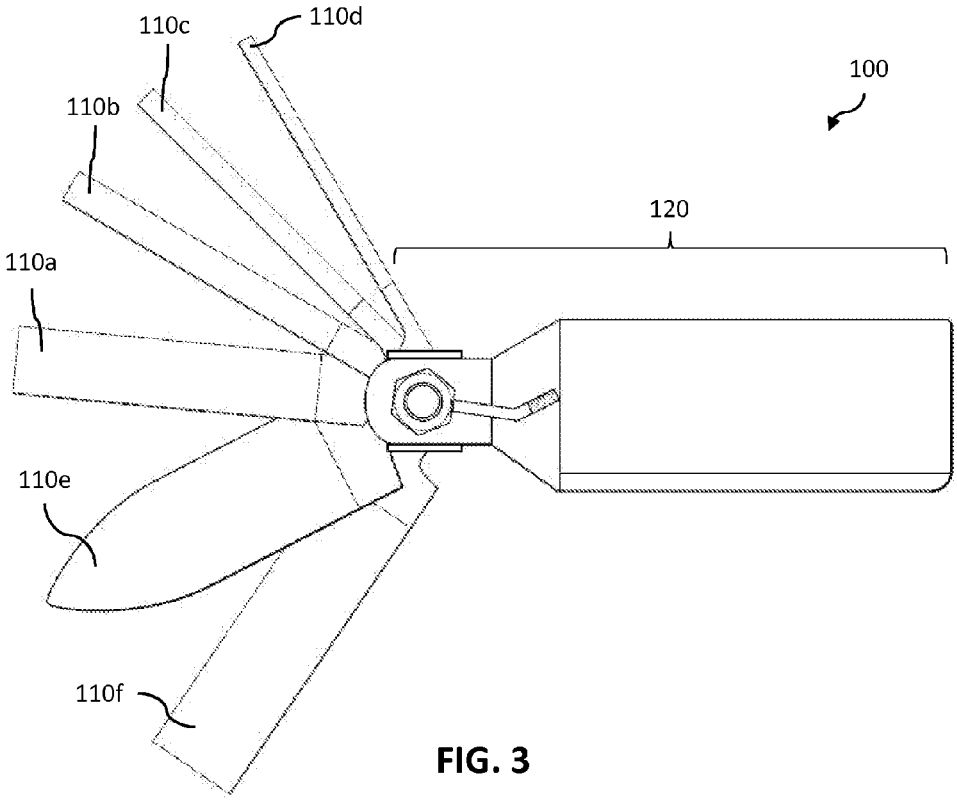
FIG. 3 is a view of the folding masonry trowel assembly of FIG. 1 with various trowel blades partially extended in a fanned arrangement to show some or all of the multiple blades that are housed in the assembly casing.

FIG. 3 is another view of the folding masonry trowel assembly 100 of FIG. 1 with trowel blades 110*a* through 110*f* partially extended in a fanned arrangement to show some or all of the multiple blades that are housed in the assembly. The worker can fan the blades in a similar manner to view the available trowel blades 110 and select an appropriate trowel blade for the job. All but the selected trowel blade (such as trowel blade 110*a* in FIG. 2) can then be folded away into casing 120.

Figure 4:
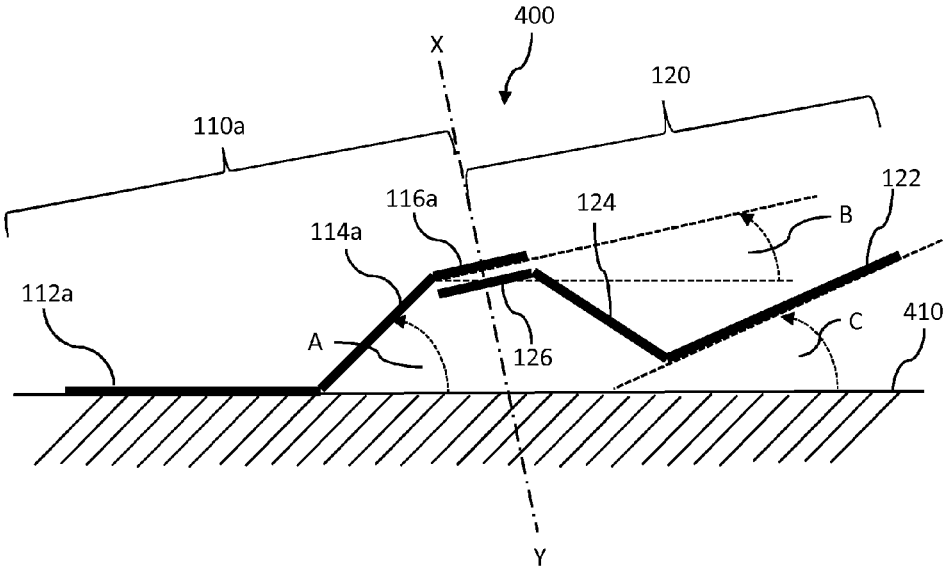
FIG. 4 is a simplified diagram showing a side view of the lower portion of a casing and a deployed trowel blade, and illustrating the angles between the various elements of the casing and the trowel blade.

FIG. 4 is a simplified diagram showing a side view of the lower portion of casing 120 and a deployed trowel blade 110*a*, and illustrating the angles between the various elements of the casing and the trowel blade. Trowel blade 110*a* comprises trowel 112*a*, neck 114*a* and neck tab 116*a*. Casing 120 comprises casing body 122, casing neck 124 and casing neck tab 126.

When trowel 112*a* is laid flat on work surface 410, neck 114*a* subtends an angle A with work surface 410. In an example embodiment, angle A (between trowel 112*a* of trowel blade 110*a* and neck 116*a*) is 45 degrees. Neck tab

116*a* subtends an angle B with a plane parallel to work surface 410, or equivalently neck tab 116*a* subtends an angle equal to angle B minus angle A with neck 114*a*. In an example embodiment, angle B is 12 degrees. Generally, angle B is less than angle A, and angle B minus angle A is a negative value. This means that neck tab 116*a* is angled down below the plane of neck 114*a*.

Trowel blade 110*a* rotates about pivot pin 140 of FIG. 1 (not shown in FIG. 4). The rotation is about axis X-Y of FIG. 4.

Generally, the angle between trowel 112*a* and neck 114*a* is substantially the same as the angle between casing body 122 and casing neck 124. Similarly, the angle between neck 114*a* and neck tab 116*a* is substantially the same as the angle between neck 124 and neck tab 126 of casing 120. In the illustrated embodiment, these angles are substantially the same. In some embodiments, these angles can vary for different trowel blades 110 in the folding trowel assembly of FIG. 1, provided that the trowel blades can still be stacked and rotated about pivot pin 140.

Referring again to FIG. 4, the plane of casing body 122 subtends an angle C with the plane of work surface 410. In the illustrated embodiment, where the elements of trowel blade 110*a* and casing 120 are constructed using substantially the same angles, angle C is twice angle B. In an example embodiment, where angle B is 12 degrees, angle C is 24 degrees.

In a conventional (single, non-folding) trowel, neck 116*a* provides spacing between the work surface and the trowel handle. In the folding trowel assembly described herein, trowel blade 110*a* is rotated out of casing 120 about an axis perpendicular to neck tabs 114*a* and 124 (axis X-Y of FIG. 4), and casing body 122 serves as a trowel handle. In this arrangement, neck 114*a* does not generally provide spacing between the work surface and the trowel handle unless neck tabs 116*a* and 126 are constructed at an angle to trowel 112*a* of trowel blade 110*a*.

In an example embodiment, where angle B of FIG. 4 is 12 degrees, casing 120 is inclined at an angle of 24 degrees to work surface 410 when trowel 112*a* of trowel blade 110*a* is placed flat on work surface 410. This angle in combination with neck 116*a* provides sufficient clearance between casing 120 and work surface 410 when casing 120 is used as the handle for trowel blade 110*a*.

The following paragraphs describe example methods and materials that can be used in the manufacture of the folding trowel assembly such as example embodiment 100 in FIG. 1. In one embodiment, the materials are soft steel and aluminum. The blades can be made of tempered steel, spring steel, plastic or a hardened material. For most applications, it is desirable that the blade material is chosen such that it does not bend permanently when flexed or twisted, that is, it should return to its original shape after flexing or twisting.

Figure 5:
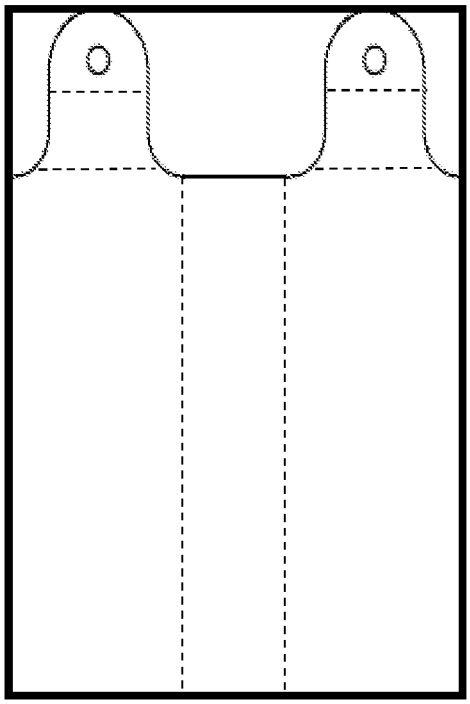
FIG. 5 is a plan view showing how the casing of the folding masonry trowel assembly of FIG. 1 can be cut and formed from a sheet of metal.

Casing 120 of FIG. 1 comprises two sides connected by a thin strip along the long edge. FIG. 5 is a plan view showing how the casing of the folding masonry trowel assembly of FIG. 1 can be cut and formed from a single sheet of metal. Casing 120 can be constructed from a single rectangular metal sheet of aluminum approximately ⅛" thick, 4¾" wide, and 7" long. Other embodiments can use different material, have different dimensions or be constructed from more than one sheet of material. The two sides of casing 120 can be separate and held together in the assembly by a pivot pin, such as pivot pin 140 of FIG. 1 or by another suitable mechanism.

A temporary pin can be used as a guide during construction of the folding trowel assembly until pivot pin 140 is ready for insertion.

Figure 6:
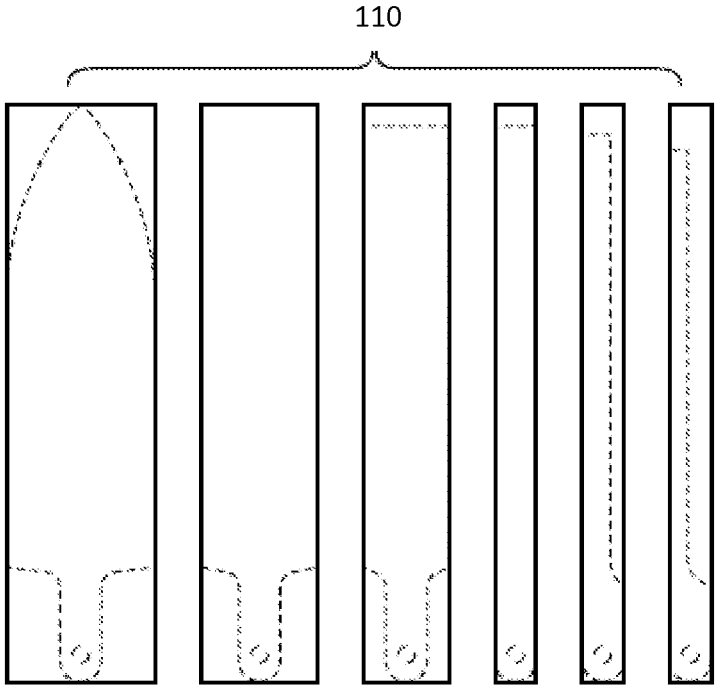
FIG. 6 is a plan view showing how various trowel blades can be cut from a sheet of metal, as indicated by the dashed lines.

FIG. 6 is a plan view showing how various trowel blades can be cut from one or more sheets of metal, as indicated by the dashed lines.

Figure 7:
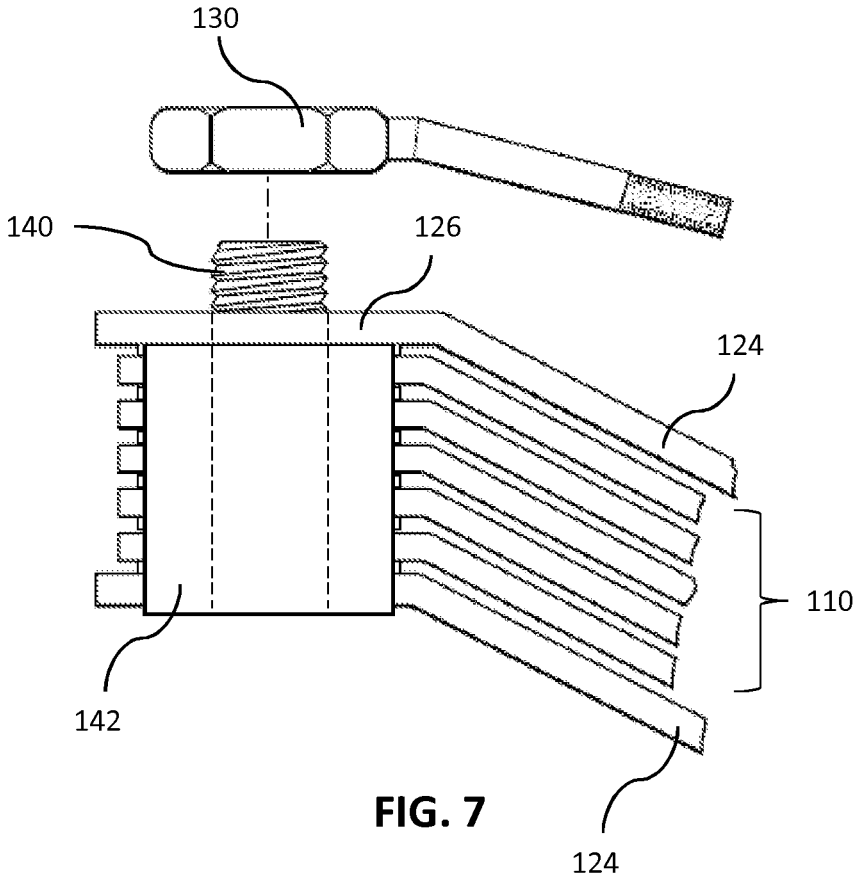
FIG. 7 is a partial side view of the folding trowel assembly of FIG. 1 showing the attachment of a thumb lock device to a pivot pin.

FIG. 7 is a partial side view of folding trowel assembly 100 of FIG. 1 showing the attachment of thumb lock device 130 to pivot pin 140 and blade guard 142. Once tightened, thumb lock device 130 creates a locked assembly of trowel blades 110 within casing 120 comprising casing body (not shown in FIG. 7), casing neck 124 and casing neck tab 126.

In operation, thumb lock device 130 can be released sufficiently to allow trowel blades 110 to be unfolded or shaken loose from the closed (folded and/or stacked) position to expose one or more trowel blades (see for example FIG. 2).

Neck 124 can be formed by bending the sheet metal of casing 120 to create an angle between casing body 122 and neck 124. Both sides of casing 120 should be bent through the same angle so that the sides of neck 124 are parallel to one other. In one embodiment, the angle is 45 degrees.

Neck tab 126 can be formed by bending the sheet metal of casing 120 to create an angle between neck 124 and neck tab 126. Both sides of casing 120 should be bent through the same angle so that the sides of neck tab 126 are parallel to one another. In one embodiment, the angle is 33 degrees. The angle between the plane of neck tab 126 and the plane of casing body 122 is 12 degrees. The selection of this angle is a factor in achieving suitable clearance between casing 120 (serving as the handle for trowel 112*a*) and the work surface.

The folding trowel assembly can contain one or more trowel blades 110. The types, sizes and shapes of trowel blades 110 can vary. In some embodiments, the trowel blade widths may be for example ¼", ½", ¾", 1", 1½", and 1¾".

Figure 8:
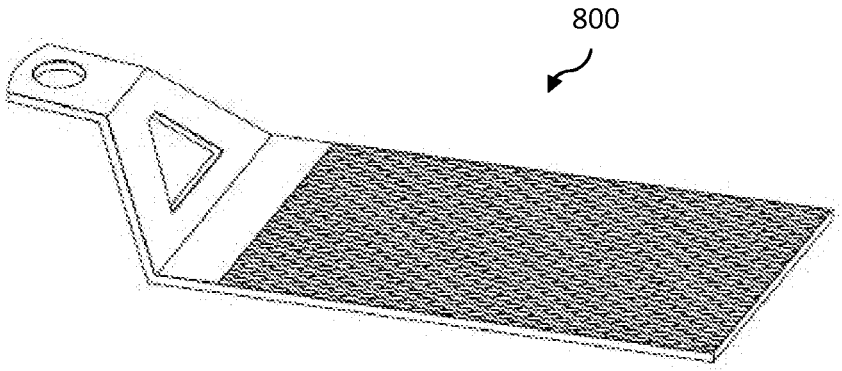
FIG. 8 shows an example of a rasping trowel blade.
Figure 9:
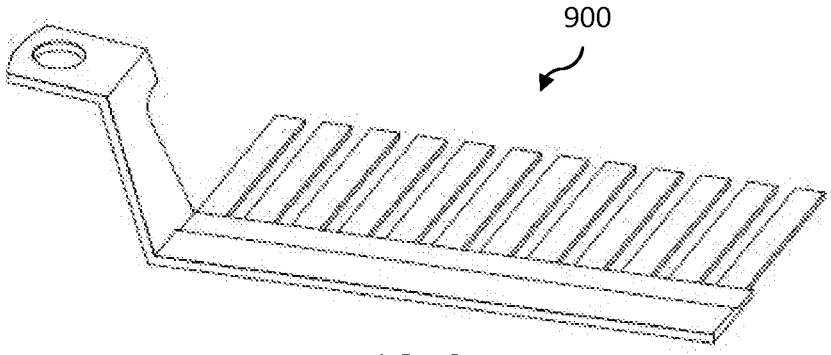
FIG. 9 shows an example of a rake trowel blade.
Figure 10:
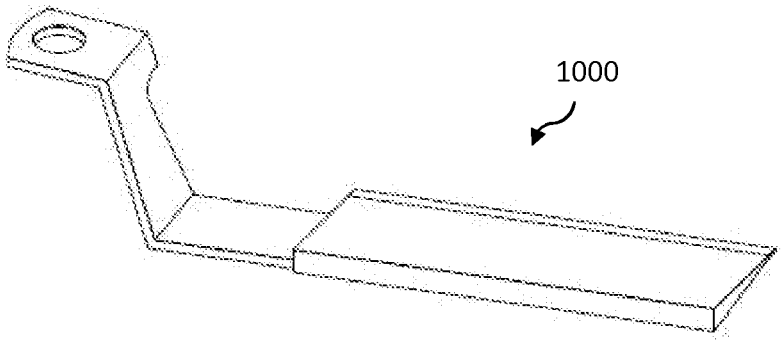
FIG. 10 shows an example of a knife trowel blade.
Figure 11:
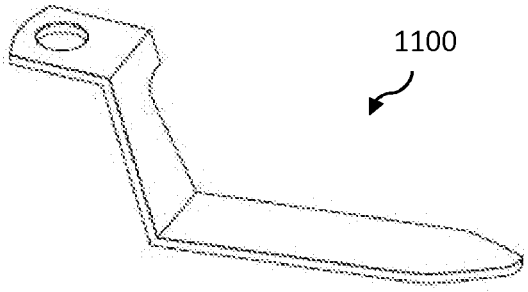
FIG. 11 shows an example of a finger grouting trowel blade.
Figure 12:
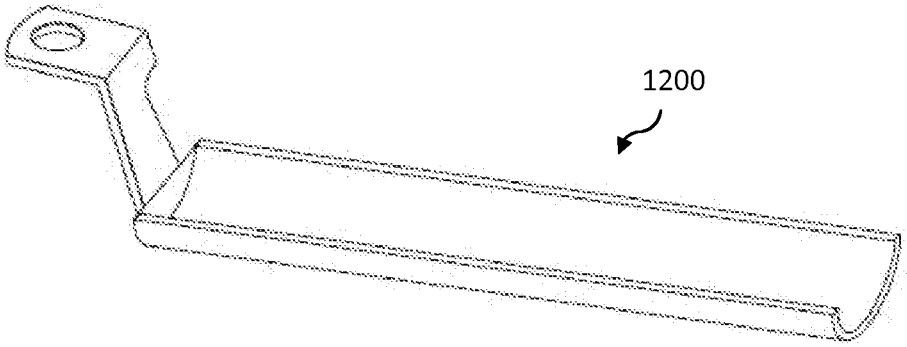
FIG. 12 shows an example of a ½" round grouting trowel blade.
Figure 13:
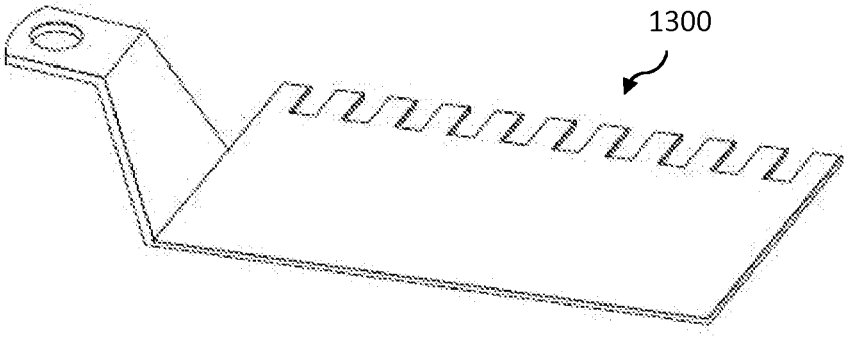
FIG. 13 shows an example of a notched trowel blade.
Figure 14:
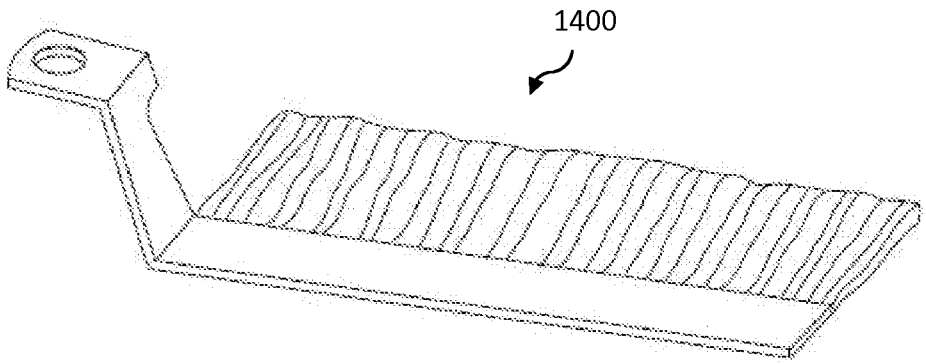
FIG. 14 shows an example of a brush trowel blade.
Figure 15:
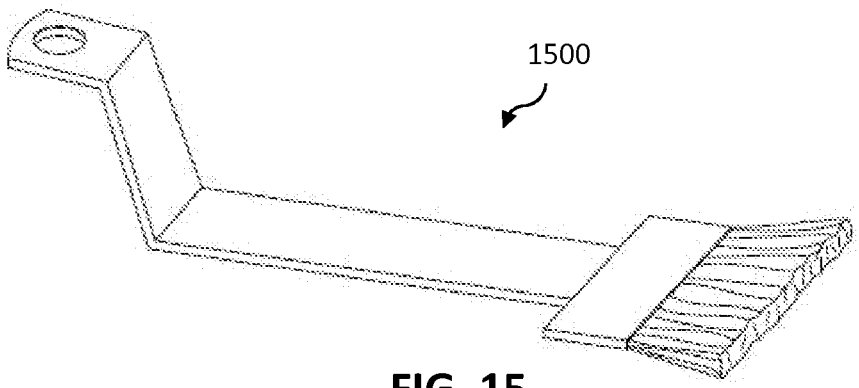
FIG. 15 shows an example of a narrow brush trowel blade.
Figure 16:
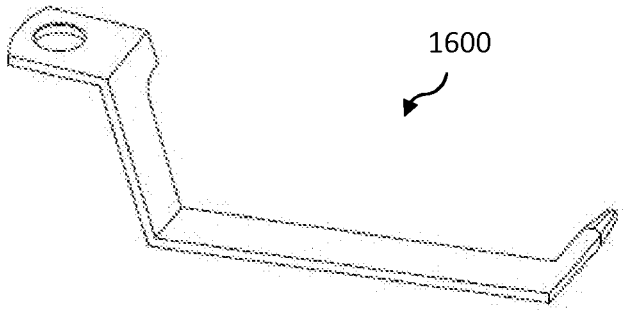
FIG. 16 shows an example of an expansion trowel blade.
Figure 17:
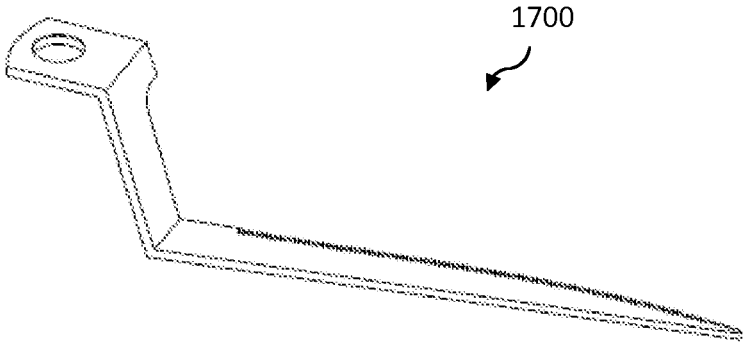
FIG. 17 shows an example of a keyhole saw trowel blade.
Figure 18:
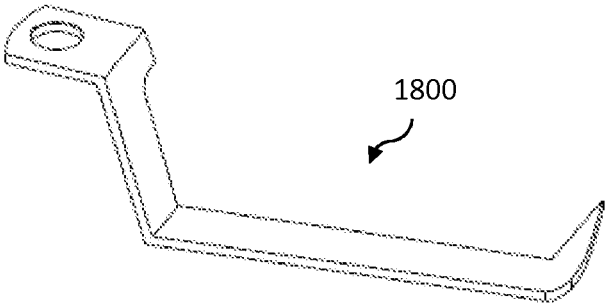
FIG. 18 shows an example of a hooked trowel blade.
Figure 19:
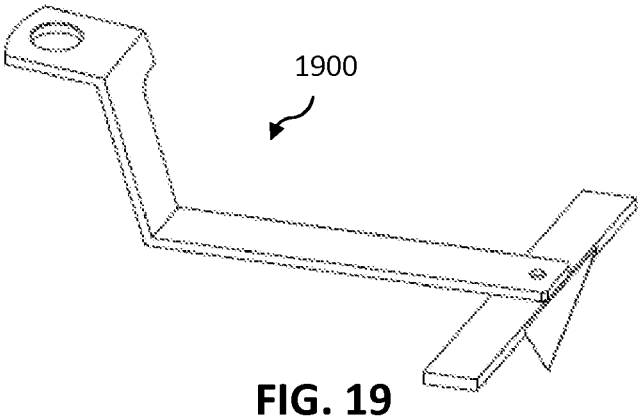
FIG. 19 shows an example of a grooving trowel blade.
Figure 20:
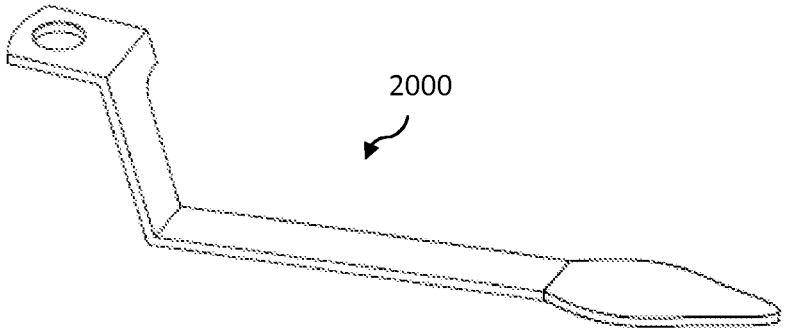
FIG. 20 shows an example of a pointer trowel blade.

Example trowel blades 110 are illustrated in FIGS. 8 through 20. FIG. 8 shows a rasping trowel blade 800. FIG. 9 shows a rake trowel blade 900. FIG. 10 shows a knife trowel blade 1000. FIG. 11 shows a finger grouting trowel blade 1100. FIG. 12 shows a ½" round grouting trowel blade 1200. FIG. 13 shows a notched trowel blade 1300. FIG. 14 shows a brush trowel blade 1400. FIG. 15 shows a narrow brush trowel blade 1500. FIG. 16 shows an expansion trowel blade 1600. FIG. 17 shows a keyhole saw trowel blade 1700. FIG. 18 shows a hooked trowel blade 1800. FIG. 19 shows a grooving trowel blade 1900. FIG. 20 shows a pointer trowel blade 2000.

Figure 21:
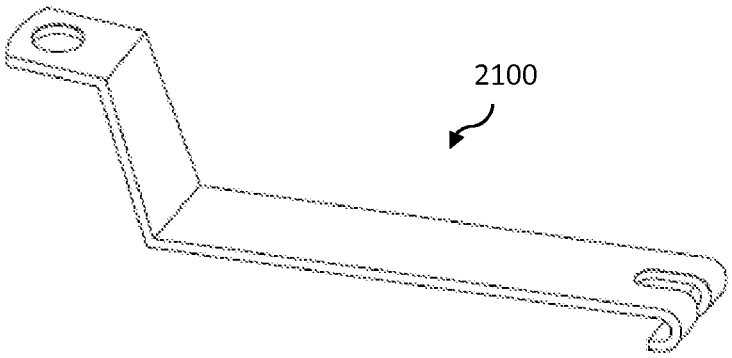
FIG. 21 shows an example of a wire tightener tool.
Figure 22:
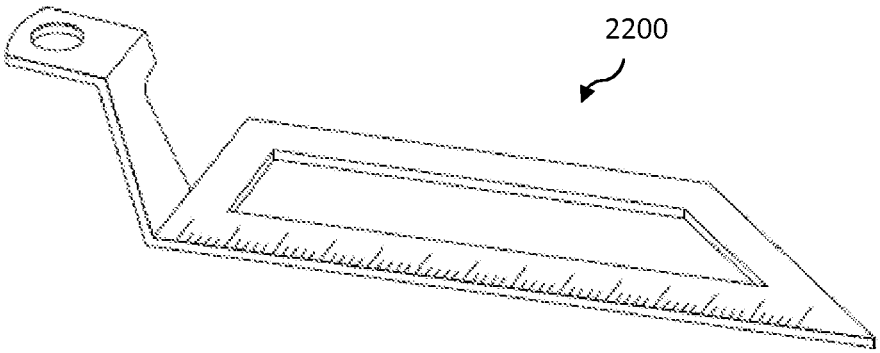
FIG. 22 shows an example of a squaring tool.

Folding trowel assembly 100 in FIG. 1 can also contain one or more other tools such as for example wire tightener 2100 shown in FIG. 21 and squaring tool 2200 shown in FIG. 22.

Other types of tools can be housed in the same casing 120 in FIG. 1 that stores assorted masonry trowel blades. In some embodiments, the trowel assembly can hold six or more different blades. In some embodiments, the blades can be readily removed and replaced with a different selection of blades. Individual blades can also be replaced if they become damaged or worn, without the need to replace the whole assembly.

To use a specific blade, the user can unfold and fan out the blades, select the desired blade and fold the rest of the blades back into the casing. The user then locks the selected blade into the desired position by tightening the thumb lock device. To release and fold away the blade, the user loosens the thumb lock device and folds the blade back into the casing. The unit can then be returned to a storage pouch and attached, for example, to a belt loop. Trowel assembly 100 of FIG. 1 can be oiled to facilitate smooth movement of trowel blades 110.

Each blade can have different functions for different types of work. The casing or casing body can be ergonomically shaped to fit the gripping motion of the hand. The outer surface of the casing body can be textured to provide a more secure grip.

The masonry industry is such that, depending on the application, a large number of different types of trowel tools may be needed. The folding trowel assembly described in this application makes it possible to carry a variety of tools in a compact assembly, interchangeably selectable for a desired application.

Figure 23A:
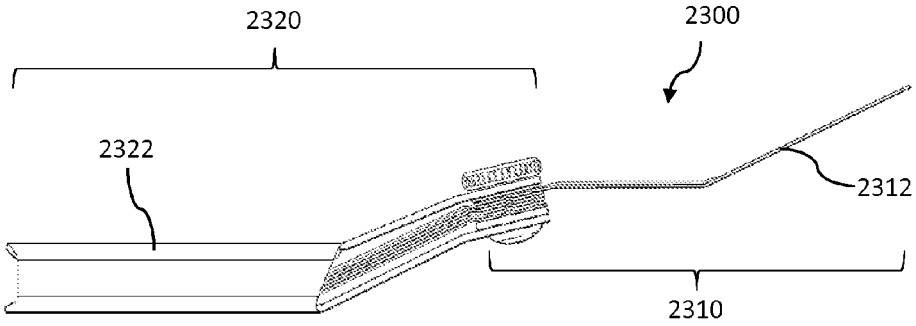
FIGS. 23A and 23B show a side view and a view of the underside, respectively, of an embodiment of a masonry trowel assembly with a selected blade extended from the casing.
Figure 23B:
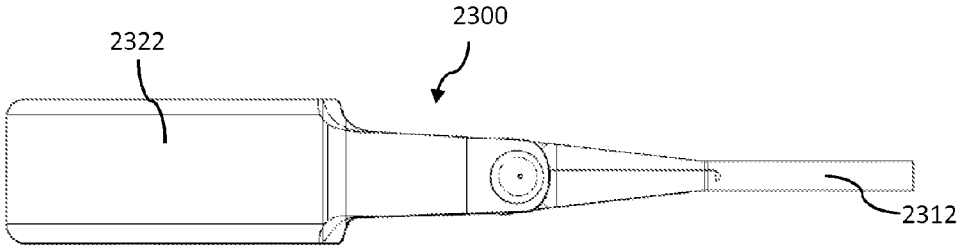

FIGS. 23A and 23B show a side view and a view of the underside, respectively, of another embodiment of a folding masonry trowel assembly 2300 with a selected blade 2310 extended from casing 2320. Casing body 2322 serves as the handle for trowel 2312. The casing is designed to hold multiple blades stacked one on top of another in compact form. It is also designed so that there is hand or knuckle room between the handle and the work surface when the trowel is laid flat along the work surface (as it would be for the most part during normal use). The clearance between the handle and the work surface is provided by the angles in the extended trowel blade and the corresponding angles in the casing. The angles in the casing are designed so that the casing can accept the trowel blades when they are all folded away and stacked with the other blades inside the casing.

Figure 24:
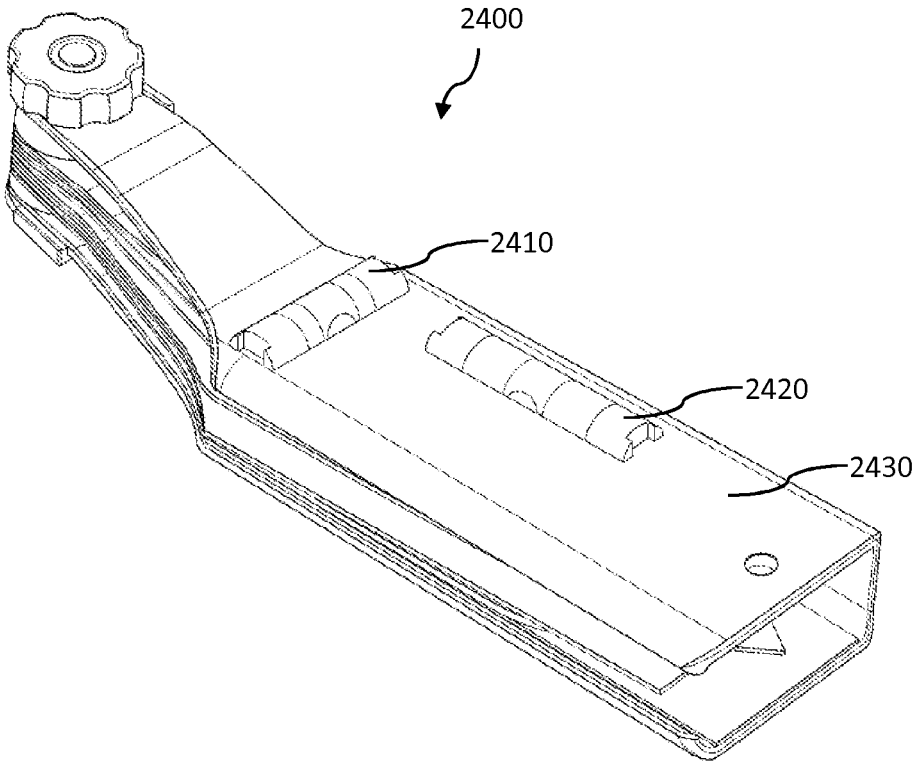
FIG. 24 is a perspective view of an embodiment of a folding trowel assembly incorporating two level indicators in the casing body.

In some embodiments, the casing can incorporate features and tools. For example, the casing can incorporate one or more level indicators. FIG. 24 is a perspective view of an embodiment of a folding trowel assembly 2400 incorporating two level indicators 2410 and 2420 on the upper surface of casing body 2430. Level indicators can be important when the user desires to produce an essentially horizontal or vertical surface with the mortar, cement, stucco or other suitable material being worked with the trowel.

In other embodiments, additional tools can be incorporated into the trowel assembly, for example, but not limited to, a brush, a knife and a plumb-bob line. Measuring increments can also be provided along the edge of the casing body.

Figure 25A:
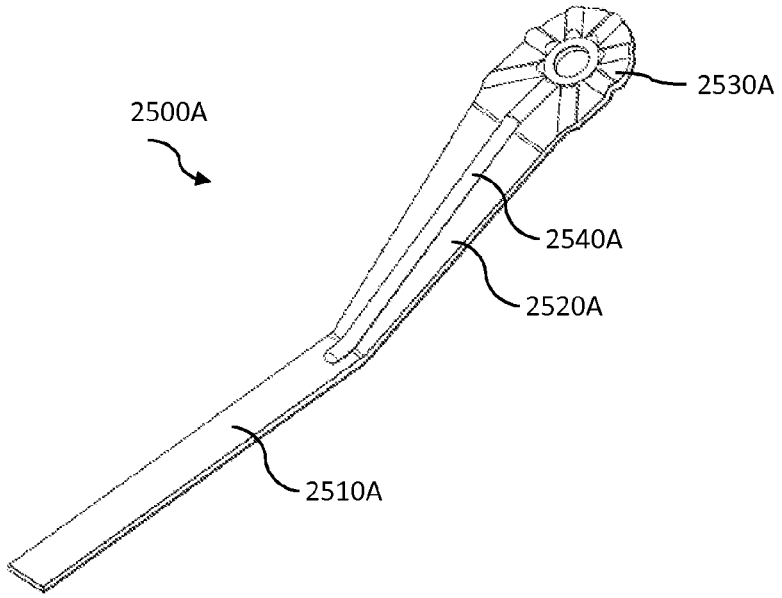
FIG. 25A shows the incorporation of blade stiffening and locking features into the trowel blade.

FIG. 25A illustrates the incorporation of blade stiffening and locking features into the trowel blade itself. It is generally desirable that while the trowel (namely, the flat or working portion of the trowel blade) is flexible, the neck should be stiff. Stiffness can be achieved for example by having one or more ribs in the neck of the blade. FIG. 25A shows trowel blade 2500A comprising trowel 2510A, neck 2520A and neck tab 2530A. Trowel blade 2500A incorporates a single stiffening rib 2540A down the center of neck 2520A, from neck tab 2530A to trowel 2510A (namely, to the flat or working portion of the trowel blade). This allows for the use of a thinner material for the blade while retaining stiffness in the neck portion.

In some embodiments, trowel blade 2500A can be held more securely in place by means of features in trowel blade 2500A that retain the blade at one or more specific angles relative to the casing, for example at 90 degrees or 180 degrees relative to the length of the casing. FIG. 25A shows an example where eight ridges or equivalent features on neck tab 2530A provide a mechanism to hold trowel blade 2500A in place at angular increments of 45 degrees.

Figure 25B:
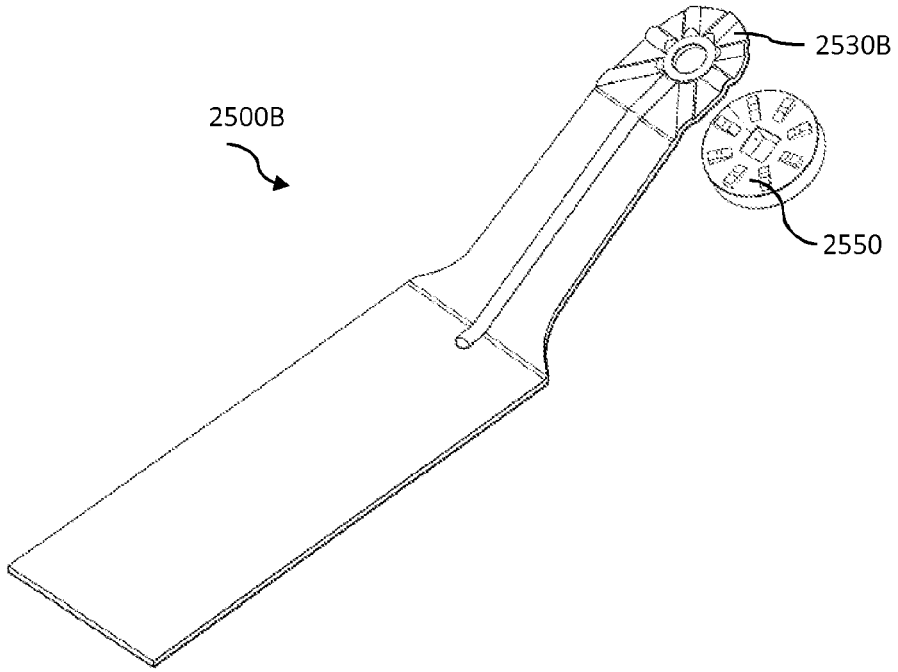
FIG. 25B shows a trowel blade with incorporated blade stiffening and locking features alongside an example of a locking washer.

FIG. 25B shows a trowel blade 2500B with incorporated blade stiffening and locking features alongside an example of a locking washer. FIG. 25B shows an example where eight ridges or equivalent features on neck tab 2530B provide a mechanism to hold trowel blade 2500B in place at angular increments of 45 degrees.

In some embodiments, features on a locking washer 2550 can be used to hold trowel blade 2500B in place at a desired position when a thumb locking device or other fastener device on the pivot pin is tightened. FIG. 25B shows an example of locking washer 2550 with eight ridges or equivalent features that allow trowel blade 2500B to be held at 45 degree increments. These features can provide positive positioning of the blade, and allow it to be held in place without undue tightening of the thumb locking device. Neck tab 2530B and locking washer 2550 can be held in place using hardware such as thumb nuts, carriage bolts and washers, or other suitable hardware.

Figure 26:
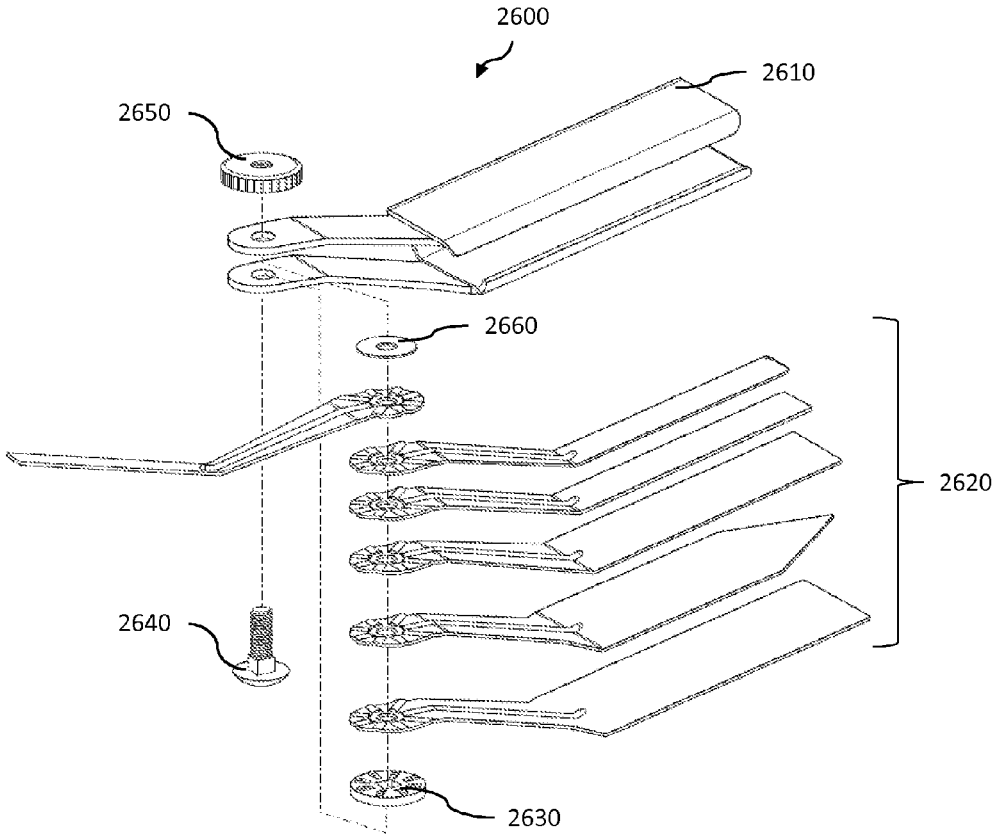
FIG. 26 is an exploded view of another embodiment of a folding trowel assembly.

FIG. 26 shows an exploded view of an embodiment of a folding trowel assembly 2600. Trowel assembly 2600 comprises casing 2610, six example trowel blades 2620, a locking washer 2630 and hardware (a screw 2640, a nut 2650 and a washer 2660) to hold the assembly together.

In other embodiments, a locking pin can be used to hold trowel blades 2620 in place.

Figure 27A:
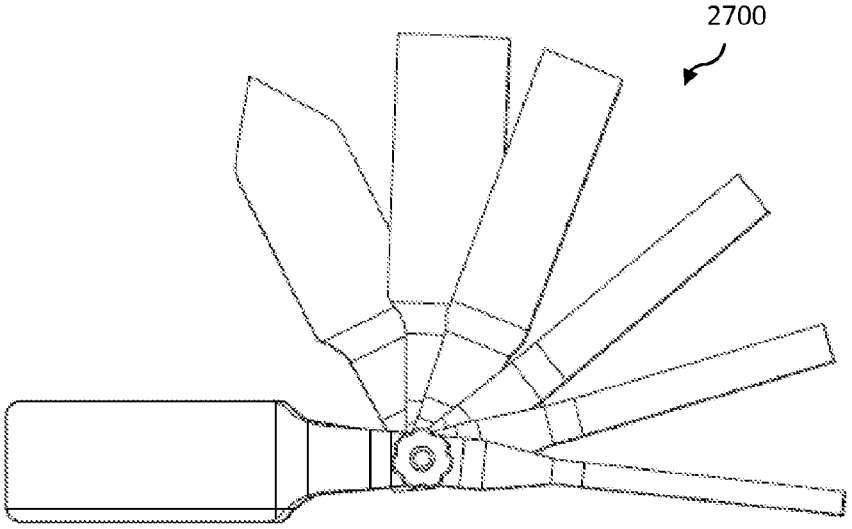
FIG. 27A is a plan view of the folding trowel assembly of FIG. 26 with the trowel blades unfolded and fanned out for selection.
Figure 27B:
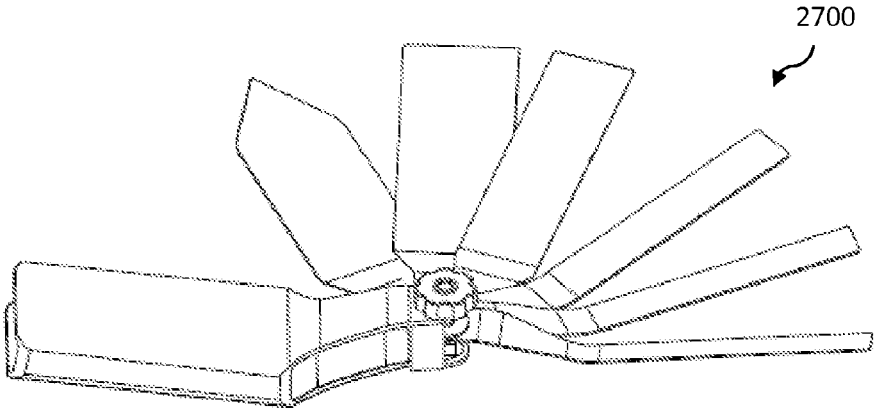
FIG. 27B is a perspective view of the trowel assembly of FIG. 27A with the trowel blades unfolded and fanned out for selection.

FIG. 27A shows a plan view of a folding trowel assembly 2700 with the multiple trowel blades unfolded and fanned out for selection. FIG. 27B shows a perspective view of the trowel assembly 2700 of FIG. 27A with the trowel blades unfolded and fanned out for selection.

Figure 28:
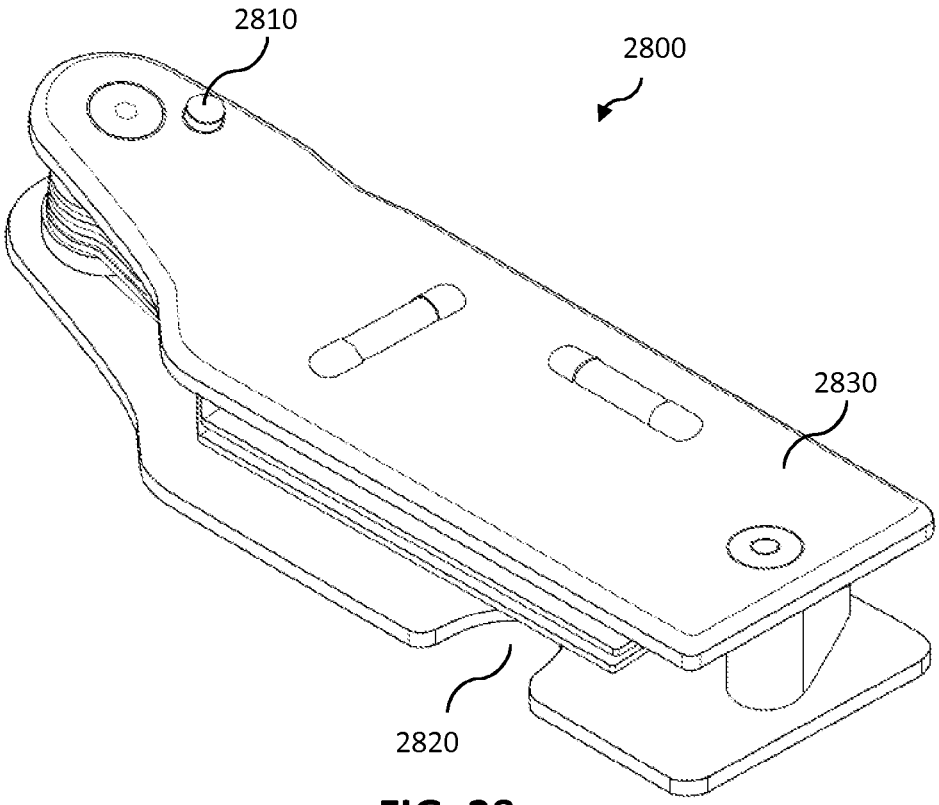
FIG. 28 shows an embodiment of a folding trowel assembly with a push-button release mechanism.

In some embodiments, a quick-release mechanism such as a push-button release can be used to allow the blades to be rotated out of the casing (that is, unfolded) for selection and use. FIG. 28 shows an embodiment of a trowel assembly 2800 with a push-button release mechanism 2810. In one embodiment, the push-button release mechanism is adjacent to the pivot pin, and extends through the neck tab of the casing and the trowel blades.

In some embodiments, such as that shown in FIG. 28, the casing can be designed to include a setback 2820 in casing body 2830 so that a portion of at least one blade is revealed. thereby permitting the user to push or pull the blades out of the casing more easily.

Figure 29:
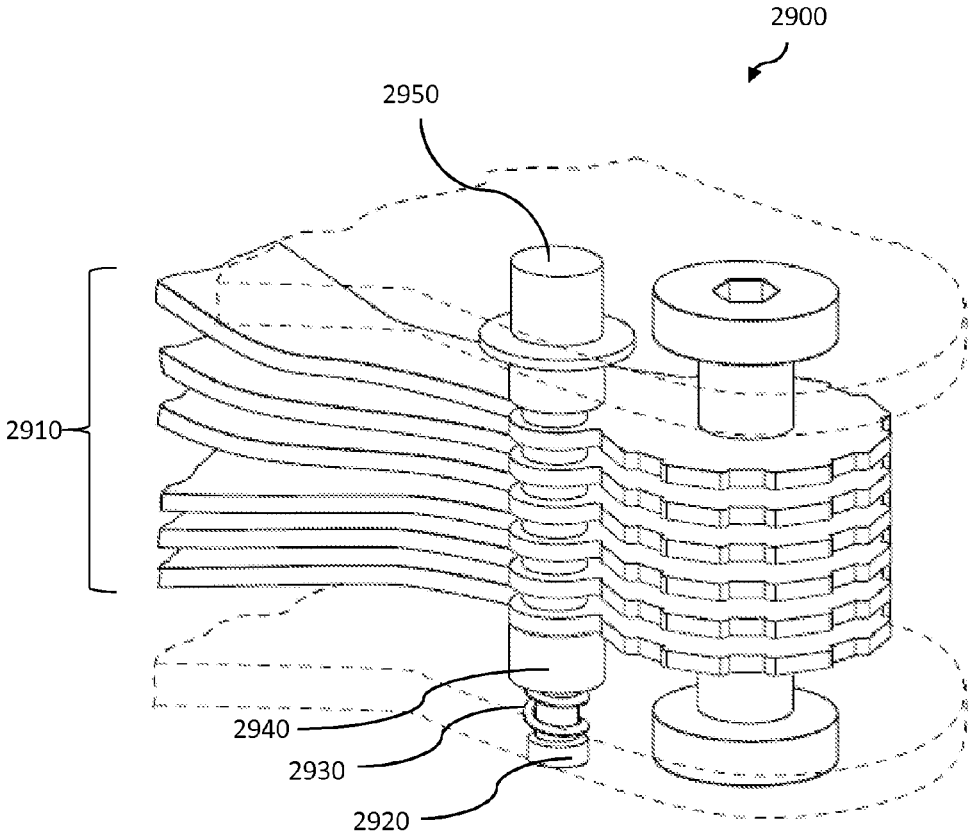
FIG. 29 is a detailed perspective view of an example push-button release mechanism.

FIG. 29 shows a detailed view of an example push-button release mechanism located in the neck tab portion of folding trowel assembly 2900. The push-button release mechanism comprises pin 2920, spring 2930, outer sleeve 2940 and push button 2950. In one embodiment, outer sleeve 2940 is stepped (or ribbed) with different diameters along its length. Spring 2930, which is coiled onto pin 2920 below outer sleeve 2940, pushes outer sleeve 2940 up so that the larger diameter portions of outer sleeve 2940 line up with the blades 2910 and grip them in a secure position. When outer sleeve 2940 is pushed down by pressing on push button 2950, the larger diameter portions of outer sleeve 2940 line up with the spacing washers that are between each pair of trowel blades 2910, allowing the blades to rotate freely. The blades can optionally have one or more small recesses to provide positive positioning of the selected blade at one or more angles. The push button 2950 can be integral with outer sleeve 2940.

Figure 30:
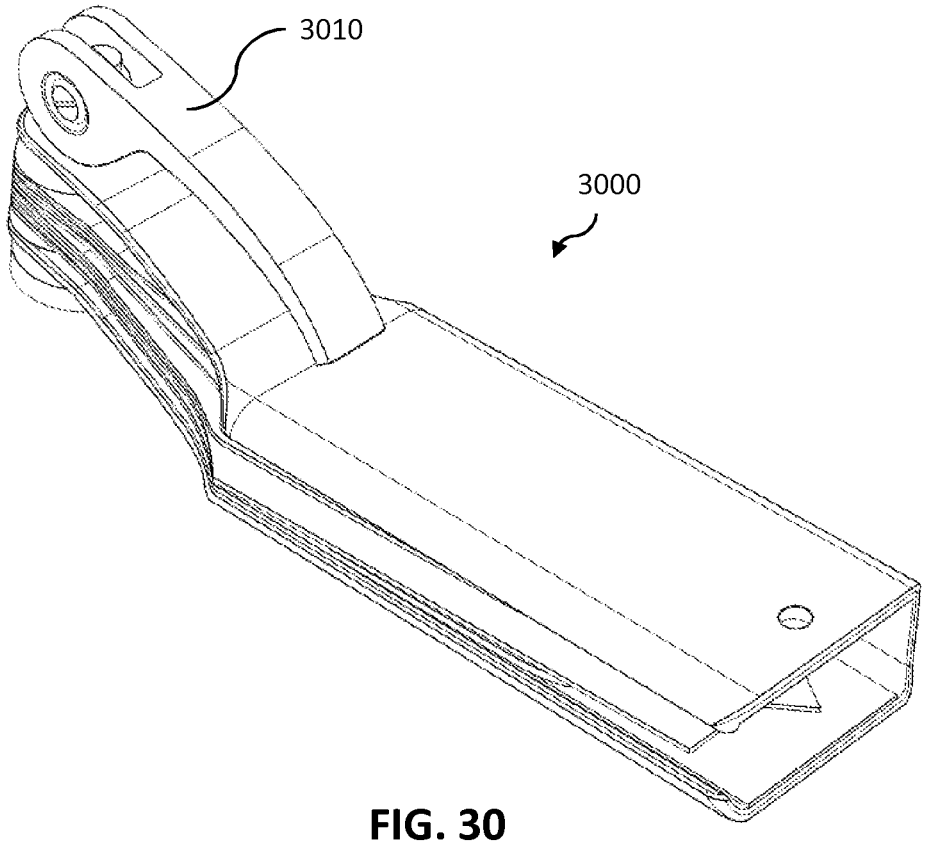
FIG. 30 shows an embodiment of a folding trowel assembly with a cam lever release mechanism.

In other embodiments, a quick-release mechanism such as a cam lever can be used to allow the blades to be rotated out of the casing (that is, unfolded) for selection and use, and to secure the blades in place once the desired blade has been selected and positioned, and the remaining blades returned to the casing. FIG. 30 shows an embodiment of a folding trowel assembly 3000 with a cam lever release mechanism 3010.

Trowel blades can be shaped and sized for a variety of end uses. As described above, folding trowel assemblies as described herein are particularly suitable for masonry applications. The trowel assembly and trowel blades can be sized so that they are suitable for fine work and for work in small or confined areas. For other situations, a larger trowel assembly can be used.

Embodiments of the folding trowel assembly can be used in other applications, such as, for example, tiling, archeology, geology and cake decoration. The casing can be designed to accommodate different sets of trowel blades, each set for a different application. Individual trowel blades and sets of trowel blades can be interchanged in the trowel assembly to suit particular applications. The casing (including the size, shape, thickness, construction materials and pivoting and locking mechanism) can be designed to suit a particular end use.

While particular elements, embodiments and applications of the present invention have been shown and described, it will be understood that the present invention is not limited thereto, since modifications can be made by those skilled in the art without departing from the scope of the present disclosure, particularly in light of the foregoing teachings.

What is claimed is:

1. A folding trowel assembly comprising:

(a) a stacked plurality of trowel blades, each of said trowel blades comprising a trowel, a trowel blade neck and a trowel blade neck tab, said trowel blade neck tab angled to said trowel blade neck and angled to said trowel, said trowel blade neck tab having a hole formed therein for receiving a pivot pin;

(b) a casing for housing said stacked plurality of trowel blades, said casing comprising a casing body, a casing neck and a casing neck tab, said casing neck tab angled to said casing neck and angled to said casing body, said casing neck tab having at least one hole formed therein to receive said pivot pin;

(c) a pivot mechanism comprising at least said pivot pin for positioning each of said trowel blades into a working position at an adjustable angle relative to said casing;

(d) a release mechanism operatively associated with said pivot mechanism, said release mechanism capable of applying compression to said stacked plurality of trowel blades to inhibit rotation of said trowel blades about said pivot pin and relieving compression from said stacked plurality of trowel blades to permit rotation of said trowel blades about said pivot pin;

wherein an angle between said casing body and said casing neck tab allows said trowel blades to be pivoted such that sufficient clearance is provided between said casing body and a work surface to permit said casing body to be used as a handle for each of said trowel blades.

2. The folding trowel assembly of claim 1, wherein said casing neck defines a plane that is at a first angle of between 20 degrees and 60 degrees to a plane defined by said casing body, and wherein said casing neck tab defines a plane that is at a second angle of between 5 and 30 degrees to said plane defined by said casing body, wherein said second angle is less than said first angle.

3. The folding trowel assembly of claim 2 wherein said first angle is about 45 degrees and said second angle is about 12 degrees.

4. The folding trowel assembly of claim 1, wherein each of said trowel blades is rotatable approximately 180 degrees from a housed position within said casing.

5. The folding trowel assembly of claim 1, wherein said pivot pin comprises a threaded end and a flanged end, said release mechanism comprising a threaded fastener cooperative with said pivot pin threaded end, whereby rotation of said fastener in a first direction compresses said trowel blades against said pivot pin flanged end and rotation of said fastener in a second, opposite direction relieves compression of said trowel blades against said pivot pin flanged end.

6. The folding trowel assembly of claim 5, wherein said threaded fastener comprises a thumb lock.

7. The folding trowel assembly of claim 1, wherein said pivot pin comprises a cam end and a flanged end, said release mechanism comprising a cam lever cooperative with said cam end, whereby orienting said cam lever in a closed position compresses said trowel blades against said pivot pin flanged end and orienting said cam lever in an open position relieves compression of said trowel blades against said pivot pin flanged end.

8. The folding trowel assembly of claim 1, further comprising a plurality of washers mounted on said pivot pin and interposed between neighboring trowel blade neck tabs.

9. The folding trowel assembly of claim 1, wherein said pivot mechanism comprises first physical features formed on one side of said trowel blade neck tab and second physical features formed on an opposite side of said trowel blade neck tab, said first and second physical features cooperative with second and first physical features, respectively, formed on neighboring trowel blade neck tabs, whereby rotating a trowel blade about said pivot pin orients said trowel blade at fixed angular increments upon compression of said stacked plurality of trowel blades.

10. The folding trowel assembly of claim 9, wherein said first physical features comprise radial ridges formed on said trowel blade neck tab first side and cooperating radial indentations formed on said trowel blade neck tab second side.

11. The folding trowel assembly of claim 9, wherein said pivot mechanism further comprises a plurality of locking washers mounted on said pivot pin and interposed between neighboring trowel blade neck tabs, said locking washers comprising first physical features formed on one side thereof and second physical features formed on an opposite side thereof, said first and second locking washer physical features cooperative with second and first physical features, respectively, formed on said neighboring trowel blade neck tabs.

12. The folding trowel assembly of claim 1, wherein said pivot pin has a flanged end and a blade guard extending therefrom for shielding said plurality of trowel blades housed within said casing.

13. The folding trowel assembly of claim 1, wherein, for each of said plurality of trowel blades, said trowel blade neck defines a plane that is at a first angle of between 20 degrees and 60 degrees to a plane defined by said trowel, and wherein said trowel blade neck tab defines a plane that is at a second angle of between 5 and 30 degrees to said plane defined by said trowel, wherein said second angle is less than said first angle.

14. The folding trowel assembly of claim 1, wherein said casing body has at least one of a level mounted on an exterior facing surface thereof and ruler markings formed on an exterior surface thereof.

15. The folding trowel assembly of claim 1 wherein said release mechanism is a push-button release mechanism.

16. The folding trowel assembly of claim 15, wherein said folding trowel assembly further comprises a plurality of spacing washers mounted on said pivot pin and interposed between neighboring trowel blade neck tabs, and said push-button release mechanism comprises:

(i) an outer sleeve having a depressor end, said outer sleeve having an interior cavity formed therein for receiving said pivot pin, said outer sleeve having a plurality of spaced concentric grooves formed in an exterior surface thereof, each of said grooves alignable with one of said spacing washers, said outer sleeve exterior surface normally abutting said plurality of trowel blades and inhibiting rotational movement of said trowel blades about said pivot pin; and (ii) a resilient compression mechanism at an end of said pivot pin opposite said outer sleeve depressor end;

whereby translating said outer sleeve depressor end toward said pivot pin opposite end aligns said grooves with said spacer washers, thereby dissociating said outer sleeve exterior surface from said trowel blades and permitting said trowel blades to rotate about said pivot pin.

17. The folding trowel assembly of claim 16, wherein said depressor end of said outer sleeve comprises a push-button mounted on said casing neck.

18. The folding trowel assembly of claim 16, wherein said pivot pin is flanged at said end opposite said outer sleeve depressor end, and said resilient compression mechanism comprises a spring interposed between said pivot pin flange and said outer sleeve.

19. The folding trowel assembly of claim 16, wherein each of said trowel blade neck tabs has at least one recess formed therein, said at least one recess cooperating with said outer sleeve exterior surface such that said trowel blades are positionable at at least one discrete angle from a housed position within said casing.

* * * * *